United States Patent [19]

Lustig et al.

[11] Patent Number: 4,688,634

[45] Date of Patent: Aug. 25, 1987

[54] RUNNING AND SETTING TOOL FOR WELL PACKERS

[75] Inventors: Lee M. Lustig, Garland; Donald E. Ritchie, Houston, both of Tex.

[73] Assignee: Dresser Industries, Inc., Dallas, Tex.

[21] Appl. No.: 825,028

[22] Filed: Jan. 31, 1986

[51] Int. Cl.[4] ..... E21B 23/06

[52] U.S. Cl. ..... 166/120; 166/123; 166/181; 166/387

[58] Field of Search ..... 166/120, 125, 181, 182, 166/382, 387, 121, 123

[56] References Cited

U.S. PATENT DOCUMENTS

| | | | |
|---|---|---|---|
| 2,467,801 | 4/1949 | Baker | 166/120 |
| 2,624,412 | 1/1953 | Ragan | 166/120 |
| 2,630,865 | 3/1953 | Baker | 166/120 |
| 2,687,775 | 8/1954 | Baker | 166/125 |
| 4,296,806 | 10/1981 | Taylor et al. | 166/120 |
| 4,516,634 | 5/1985 | Pitts | 166/120 |

FOREIGN PATENT DOCUMENTS

| | | | |
|---|---|---|---|
| 709306 | 5/1954 | United Kingdom | 166/120 |

*Primary Examiner*—George A. Suchfield
*Assistant Examiner*—David J. Bagnell

[57] ABSTRACT

A hydraulically actuated running and setting tool includes a stationary setting tool mandrel that is connected to the packer by releaseable collets. Variable volume chambers are provided in the tool that are arranged so that no downward movement of the components relative to the space in the well bore below the packer is necessary. Setting is accomplished by hydraulic pressure and testing of the packer can occur prior to release of the setting tool from the packer. Release of the setting tool from the packer occurs by pulling upwardly on the setting tool with equalization of the pressure above and below the packer or applying additional hydraulic pressure as in setting until sufficient force is developed to part a shear member.

7 Claims, 13 Drawing Figures

RUNNING AND SETTING TOOL FOR WELL PACKERS

BACKGROUND OF THE INVENTION

This invention relates generally to running and setting tools for use in connection with locating well packers and the like in well bores. More particularly, but not by way of limitation, this invention relates to a hydraulically operated running and setting tool for use in connection with the positioning and actuation of well packers in well bores and the like.

In the completion and treatment of oil and gas wells and the like, it is frequently necessary to locate a packer in the bore to separate or isolate various zones of the well. It is sometimes desirable or necessary to run the packer into the well bore, set it at the appropriate location, and remove the setting device from the packer and from the well. Such apparatus is illustrated in U.S. Pat. No. 4,516,634, issued May 14, 1985 to Glenn E. Pitts.

The '634 patent illustrates a running and setting tool for well packers that is extended into the well to locate the packer therein and utilizes hydraulic pressures to set the packer at the desired location. After the packer has been set, the setting tool can be released from the packer and withdrawn from the well.

Tools exemplified by the '634 patent operate generally satisfactorily. However, when the well bore below the packer is filled with liquid, difficulty is sometimes encountered since such liquid is substantially incompressible. The manipulation of such setting tools often requires downward movement of a portion of the tool against the liquid column. When this is the case, the incompressible liquid will prevent the downward movement necessary to effect the setting of the packer.

An object of this invention is to provide an improved hydraulic running and setting tool for packers that can be set in the well bore even in the presence of a solid column of liquid located in the well below the packer.

SUMMARY OF THE INVENTION

This invention provides an improved running and setting tool for a well packer having a tubular body, upper and lower slip assemblies encircling the body, a seal assembly located between the slip assemblies, and a setting sleeve for setting the slip assemblies. The improved setting tool comprises: a tubular setting tool mandrel arranged at a first end for connection to a string of pipe for lowering the setting tool and packer into the well bore; releaseable apparatus on the setting tool mandrel releaseably connecting the setting tool mandrel to the packer body; and a tubular setting member encircling the setting tool in sliding and telescoping relationship. The tubular setting member has a first end releaseably connected to the first end of the setting tool mandrel and has a second end arranged for engagement with the setting sleeve of the packer. A variable volume chamber is located between the setting tool mandrel and the setting member and a port in the setting tool mandrel connects the interior of the setting tool mandrel with the chamber. A valve is provided in the second end portion of the setting tool mandrel for selectively preventing flow through the interior of the setting tool mandrel and causing flow into the chamber to move the setting member downwardly relative to the setting tool mandrel to set the slip assemblies. Apparatus is provided on the second end portion of the setting tool mandrel for retaining the releaseable apparatus connected to the packer mandrel and for permitting the releaseable apparatus to disconnect from the packer mandrel upon upward movement of the setting tool mandrel relative to the packer whereby the running and setting tool can be withdrawn from the packer and from the well.

BRIEF DESCRIPTION OF THE DRAWING

The foregoing and additional objects and advantages of the invention will become more apparent as the following detailed description is read in conjunction with the accompanying drawing wherein like characters denote like parts in all views and wherein.

DETAILED DESCRIPTION OF THE PREFERRED EMBODIMENT

Figure 1A:
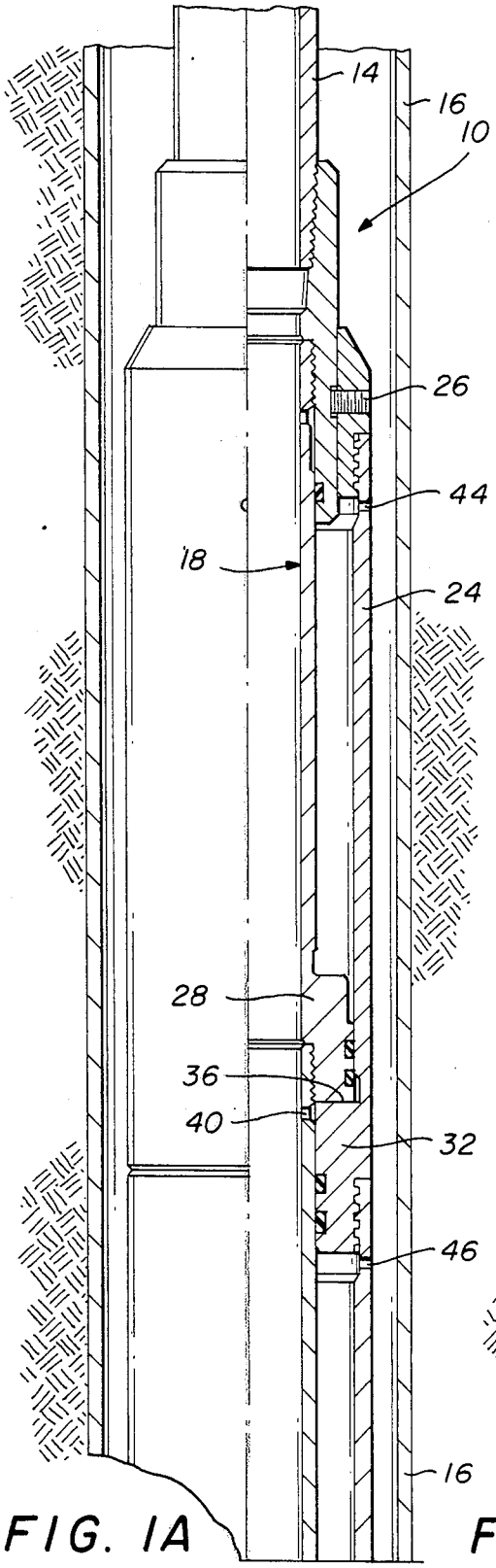
FIGS. 1A–C taken together, are an elevational view, partially in cross-section, of a setting tool that is constructed in accordance with the invention located in the well bore and having a packer attached to the lower end thereof.
Figure 1B:
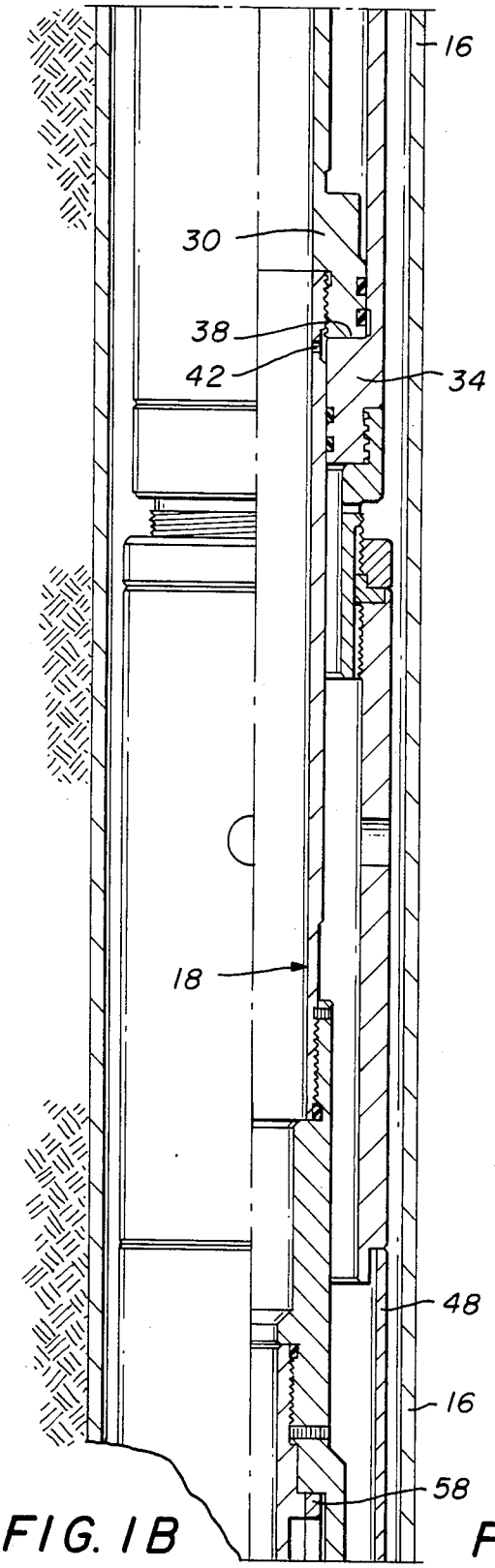
Figure 1C:
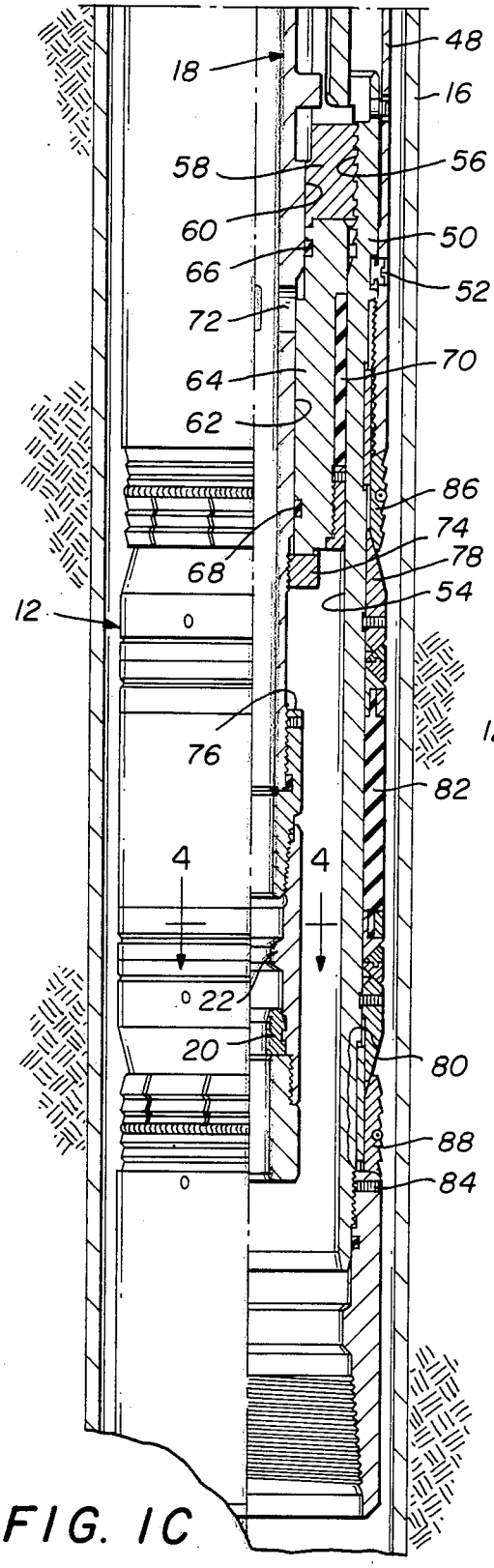

Referring to the drawing, and to FIGS. 1A–C in particular, shown therein and generally designated by the reference character 10, is a running and setting tool which is constructed in accordance with the invention. The running and setting tool 10 has a packer assembly designated by the reference character 12, attached thereto and is connected near its upper end with a string of tubing 14 that extends to the surface of the well. The tubing string 14, setting tool 10, and packer assembly 12 are illustrated as being disposed in a casing or tubing 16 that is located within a well bore (not shown).

The setting tool 10 includes a setting tool mandrel 18 that is composed of a plurality of parts threaded together and having various diameters. The varying configuration of the setting tool mandrel 18 is necessary for manufacturing purposes, for assembly, and for providing certain functional aspects of the setting tool 10. At its upper end, the setting tool 18 is connected to the tubing string 14 and is thus stationary in the casing 16 when the packer assembly 12 is located at the position where it is to be set.

Figure 4:
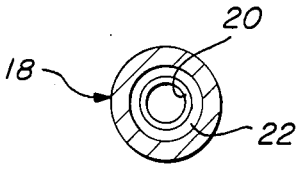
FIG. 4 is a transverse cross-sectional view taken substantially along the line 4—4 of FIG. 1C.

At its lower end, the setting tool mandrel 18 is provided with an annular valve seat 20 that is spaced just below a second annular valve seat 22 which has a larger interior diameter as may be seen more clearly in FIG. 4. The purpose of the valve seats 20 and 22 will be described more fully hereinafter.

Encircling the exterior of the setting tool mandrel 18 is a tubular setting member 24 (see FIG. 1A–B) which is releaseably connected to the setting tool mandrel 18 by a shear screw 26. It will be noted that the setting member 24 and the setting tool mandrel 18 are arranged in telescoping relationship. The mandrel 18 is provided with a pair of radially projecting flanges 28 and 30 which, in cooperation with radially inwardly projecting portions 32 and 34, respectively, on the setting member 24, define a pair of variable volume chambers 36 and 38 which can be more clearly seen in FIGS. 2A–B and 3A–B.

Upper and lower ports 40 and 42 extend radially through the setting tool mandrel 18 providing fluid communication from the interior of the mandrel 18 to the variable volume chambers 36 and 38. The chambers 36 and 38 are vented to the exterior of the tool 10 by ports 44 and 46, respectively, which extend radially through the setting member 24.

The lower end of the setting member 24 is in engagement with the upper end of a setting sleeve 48 which forms a part of the packer assembly 12. The setting sleeve 48 encircles part of a packer mandrel 50 (see FIG. 1C) and is releaseably attached to the packer mandrel 50 by a shear screw 52.

Figure 3C:
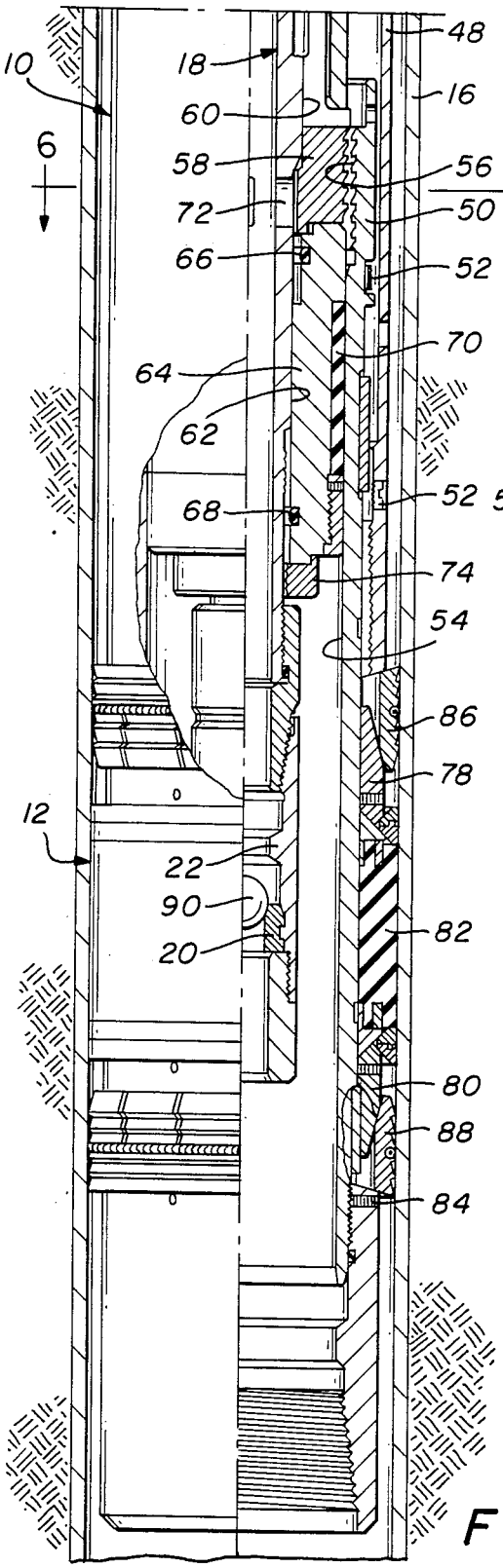
Figure 5:
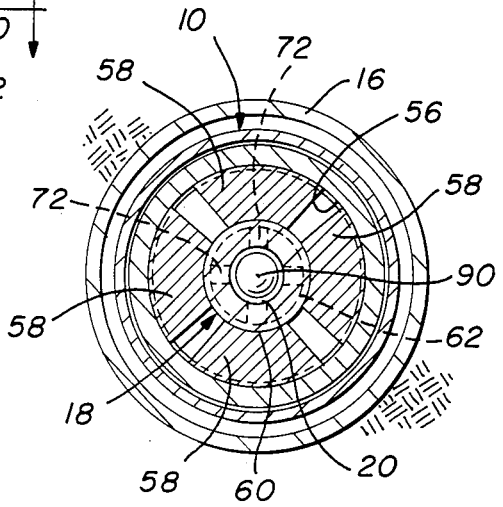
FIG. 5 is a transverse cross-sectional view taken substantially along the line 5—5 of FIG. 2C.
Figure 6:
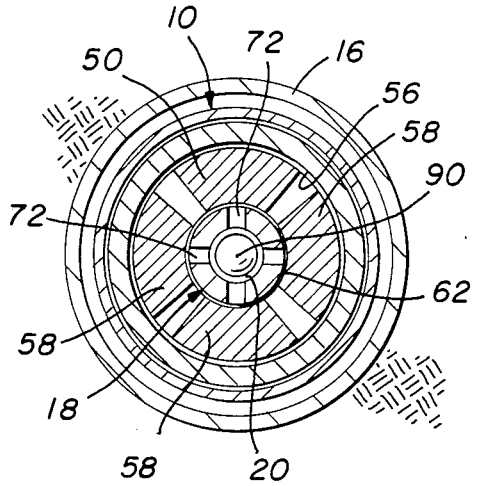
FIG. 6 is a transverse cross-sectional view taken substantially along the line 6—6 of FIG. 3C.

It will be noted that the packer mandrel 50 extends through the packer assembly 12 and has a seal bore 54 that extends axially therethrough. The upper end of the mandrel 50 is provided with a plurality of interior, annular teeth 56 that are in releaseable engagement with external teeth on a collet 58 carried by the setting tool mandrel 18. The setting tool mandrel 18 is also provided with an annular projecting enlargement 60 that is disposed in engagement with the interior of the collet 58 forcing resilient collet fingers of the collet 58 outwardly into engagement with the teeth 56 on the packer mandrel 50. An annular area of reduced diameter 62 immediately below the enlargement 60 is provided on the setting tool mandrel 18 to permit the collet 58 to move radially inwardly as illustrated in FIG. 3C disengaging the teeth on the collet 58 from the teeth 56 on the mandrel 50.

Encircling the setting tool mandrel 18 is a seal assembly 64 carrying in its interior, spaced annular seals 66 and 68 and carrying on its exterior an elongated annular seal 70 that is in engagement with the seal bore 54 of the packer mandrel 50. The seals 66 and 68 bridge equalizing ports 72 that extend radially through the setting tool mandrel 18.

Located at the lower end of the seal assembly 64 is a shear nut 74 that is threadedly attached to the exterior of the setting tool mandrel 18 and is in engagement with the lower end of the seal assembly 64. Spaced below the shear nut 74 on the exterior of the setting tool mandrel 18 is an upwardly facing abutment 76. The purpose of the abutment 76 will become more apparent as the detailed description proceeds.

Figure 2A:
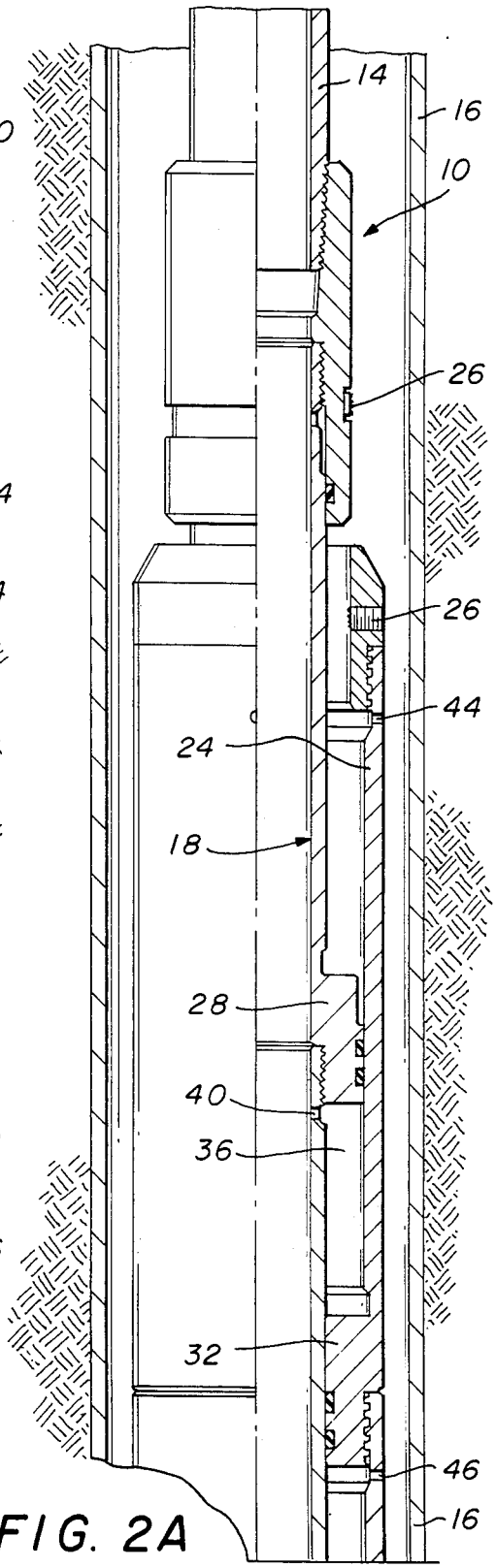
FIGS. 2A–C, taken together, are viewd similar to FIGS. 1A–C, but showing the setting tool and packer in a different operating position.
Figure 2B:
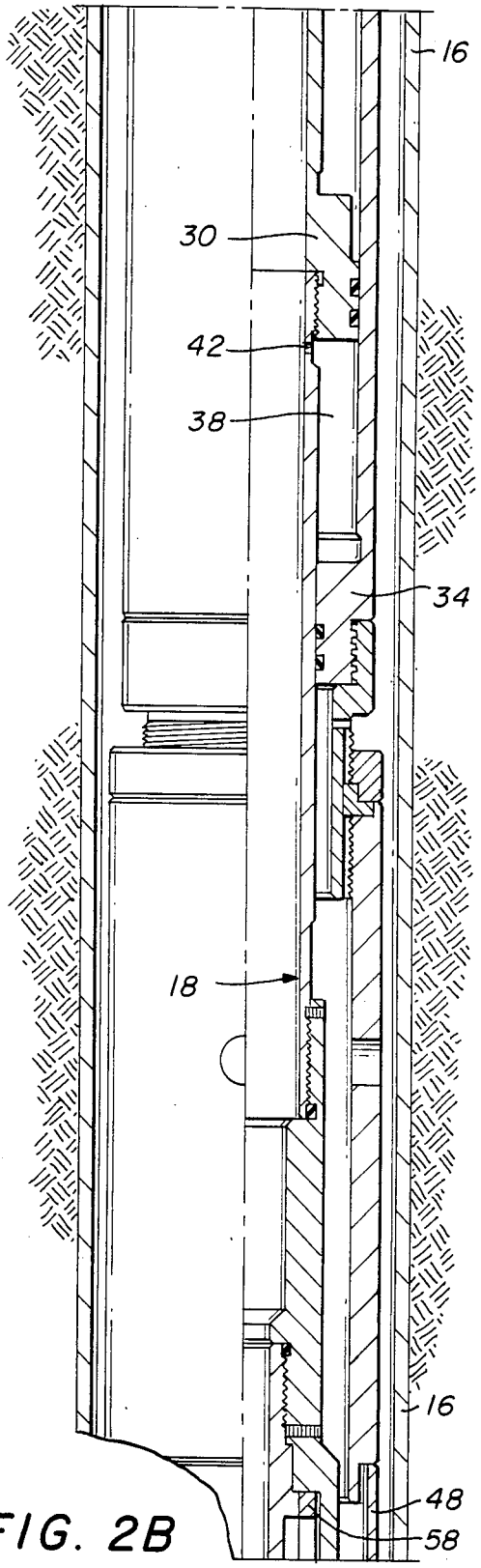
Figure 2C:
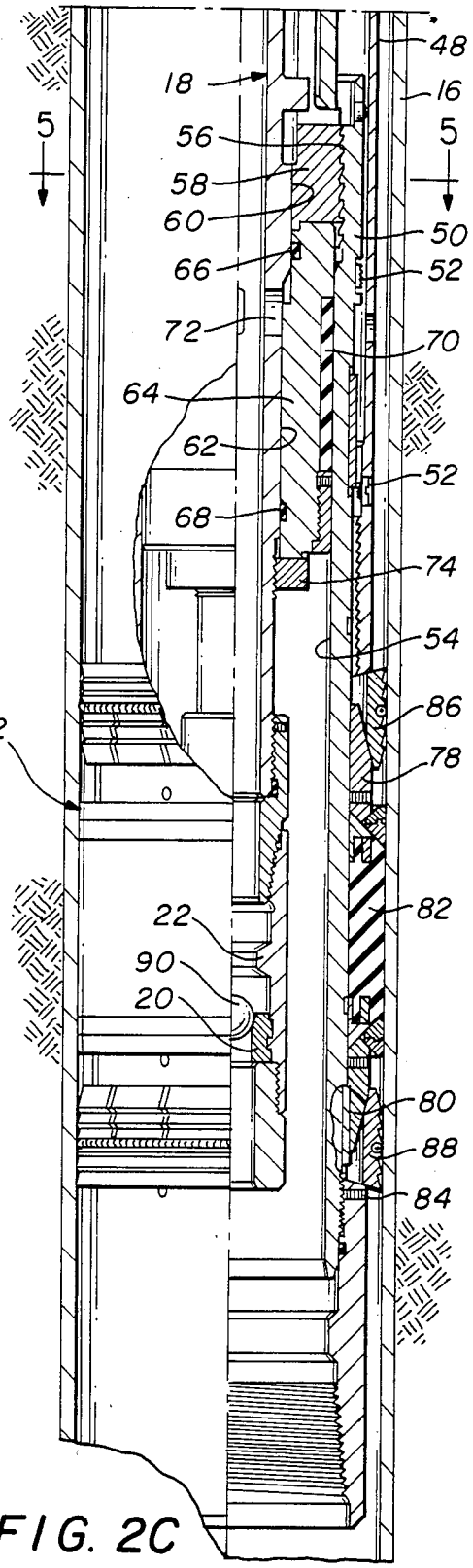
Figure 3A:
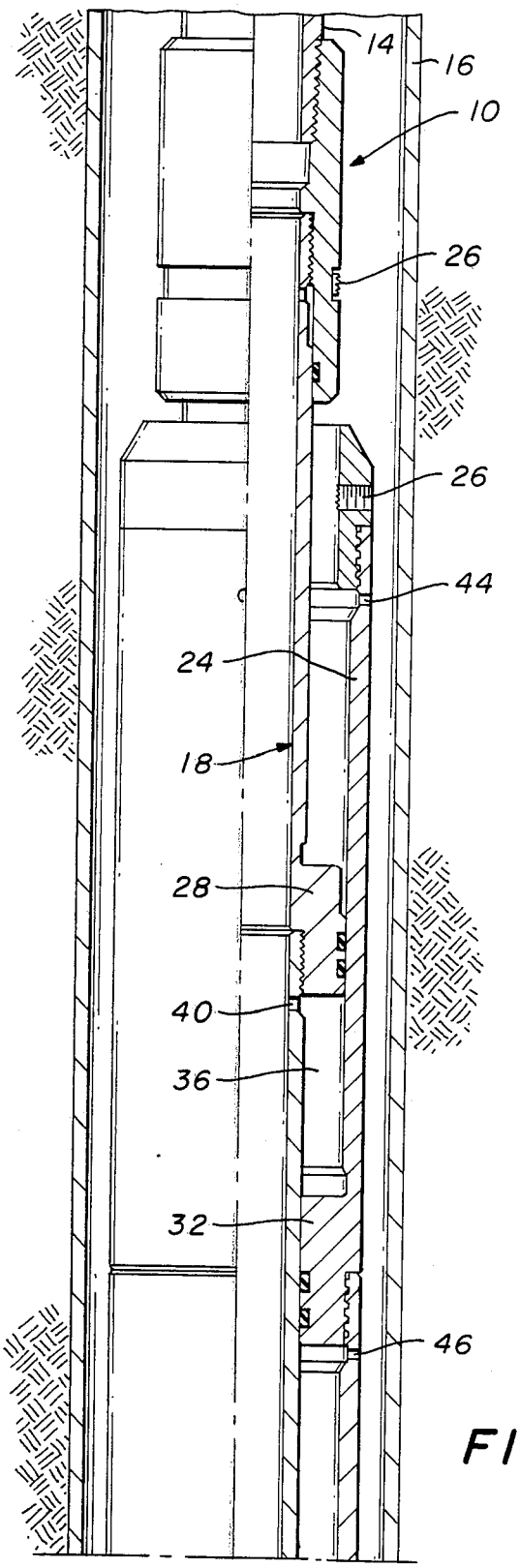
FIGS. 3A–C, taken together, are views similar to FIGS. 1A–C, but illustrating the setting tool disconnected from the packer.
Figure 7:
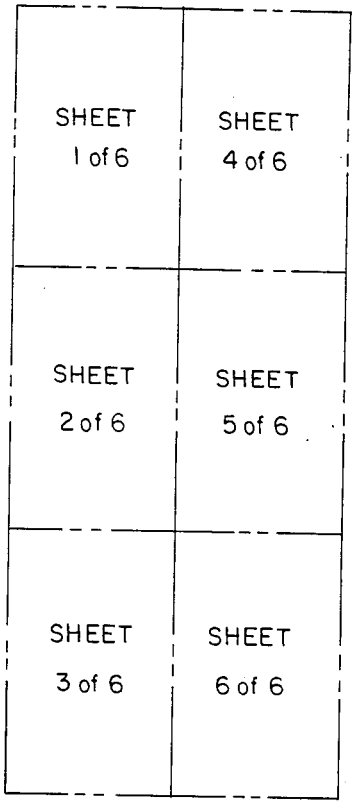
FIG. 7 is a layout showing how the sheets of the drawing should be assembled to show a complete view of the tool.
Figure 3B:
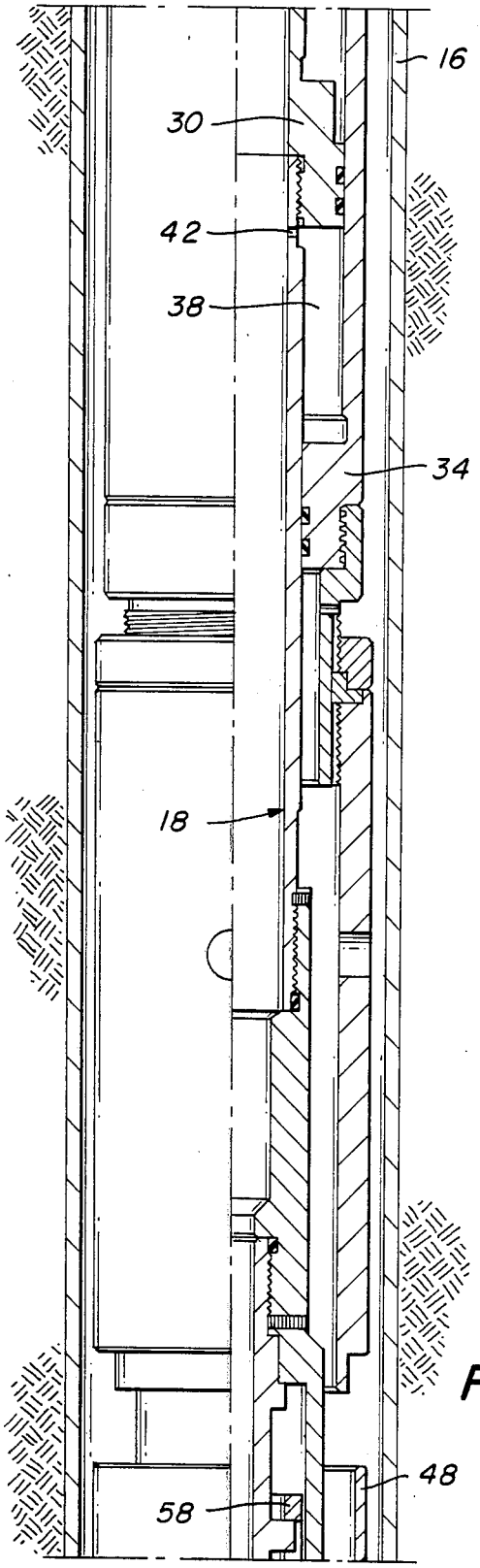

The packer assembly 12, in addition to the mandrel 50 and the setting sleeve 48, includes an upper slip assembly 78, a lower slip assembly 80, and a packer seal assembly 82. The upper slip assembly 78 is in engagement with the lower end of the setting sleeve 48 and the lower slip assembly 80 is in engagement with an upwardly facing abutment 84 provided on the exterior of the packer mandrel 50. Thus, the upper and lower slip assemblies 78 and 80 of the packer seal assembly 82 are disposed between relatively moveable members, that is, between the setting sleeve 48 and the upwardly facing shoulder 84 on the packer mandrel 50 so that movement of those members relatively together causes a collapse of the upper and lower slip assemblies 78 and 80 moving upper and lower slips 86 and 88 into holding engagement with the casing 16 and deforming the packer seal assembly 82 into engagement with the casing 16 as illustrated in FIGS. 2C and 3C.

The valve seats 20 and 22 which are located in the lower end of the setting tool mandrel 18 form part of a flow control valve. A valve closure member or a ball 90, as illustrated in FIGS. 2C and 3C, is dropped through the tubing string 14 and through the setting tool assembly 10 landing on the seat 20 and closing the interior of the setting tool mandrel 18 preventing fluid flow therethrough. Should the ball 90 fail to seal on the annular seat 20, a larger diameter ball (not shown) can be dropped through the tubing string 14 and the tool assembly 10 to land on the larger annular seat 22, and thus assure that a fluid-tight closure of the flow path through the mandrel interior is attained.

DESCRIPTION OF OPERATION

The packer assembly 12 is mounted on the running and setting tool 10 which is attached to the lower end of the tubing string 14. The thus assembled apparatus is lowered on the tubing string 14 to the desired location in the well bore. During this operation, the various parts of the apparatus are as illustrated in FIGS. 1A–C. It will be noted therein that the valve at the lower end of the mandrel 18 is open and thus liquid in the well bore will not impede the lowering of the apparatus thereinto.

Upon reaching the desired location in the well bore, the ball 90 is dropped through the tubing string 14 and falls through the interior of the setting tool mandrel 18 until it reaches the seat 20 as illustrated in FIG. 2C.

Upon reaching the seat 22, the ball closes the interior of the mandrel 18 to fluid flow and as pressure is applied above the ball 90, pressure is applied through the ports 40 and 42 into the chambers 36 and 38, respectively. As the fluid enters those chambers, the setting member 24 is driven relatively downwardly since the mandrel 18 is in a fixed position, shearing the shear screw 26 and driving the setting sleeve 48 downwardly toward the abutment 84 on the packer mandrel 50 as shown in FIGS. 2A–C. As previously mentioned, closing the distance between the end of the setting sleeve 48 and the abutment 84, collapses the upper and lower slip assemblies 78 and 80, forcing the slips 86 and 88 relatively outwardly into holding engagement with the interior of the casing 16. Simultaneously, the packer seal assembly 82 is caused to deform outwardly as the slip assemblies 78 and 80 move relatively together sealingly engaging the casing 16 as illustrated in FIGS. 2C and 3C.

During the entire setting process, the collet 58 has remained in holding engagement with the teeth 56 on the mandrel 50, thus securely attaching the setting tool 10 to the packer assembly 12. Since there is no relative movement between the setting mandrel 18 and the packer sleeve 50, there will be no adverse effect even if the well below the packer assembly 12 is a solid column of liquid. Also, the shear nut 74 remains intact since there has been no relative movement between the packer mandrel 50 and the setting mandrel 18.

At this stage, the packer assembly 12 is securely set and sealed in the well bore as shown in FIGS. 2A–C and various types of tests may be run thereon as are well known in the art. The advantage of the setting tool assembly 10 as described at this point is that the test can be run to be sure that the packer assembly 12 is properly set while the setting tool 10 remains in secure holding engagement therewith.

After the tests have been conducted, and it is desired to remove the setting tool assembly 12 from the well bore, an upward pull is taken on the tubing 14, raising the mandrel 18 therewith. Since the packer mandrel 50 is now held stationary by the set slip assemblies, the upward pull causes the seal assembly 64 on the mandrel 18 to engage the shear nut 74 and sever the shear nut from its connection to the mandrel 18 as illustrated in FIG. 3C. When this occurs, the mandrel 18 is moved upwardly relative to the packer mandrel 50 until the area of reduced diameter on the mandrel 18 is located immediately adjacent to the collet 58. With the smaller diameter under the collet 58, the collet 58 collapses radially inwardly releasing the teeth on the collet 58 from the teeth 56 on the mandrel 50.

The setting tool assembly 12 may be released by applying pressure in the chambers 36 and 38 as was done in setting the packer assembly 12. When such pressure develops sufficient force, the shear nut 74 parts and the mandrel 18 moves reciprocally relative to packer mandrel 50.

The slight upwardly movement of the mandrel 18 relative to the seal assembly 64 also moves the ports 72 on the mandrel 18 past the upper seal 66 on the seal assembly 64 to equalize pressure across the seal assembly 64 and across the packer assembly 12 faciliating removal of the setting tool 10 from the packer assembly 12. With the collet 58 thus released and the pressures balanced, the setting tool 10 is simply pulled from the packer assembly 12 and from the well bore if desired.

As will be appreciated from the foregoing detailed description, the running and setting of the packer assembly 12 by the use of the setting tool 10 has been accomplished without the necessity of moving any of the parts of the running and setting tool 10 or the packer assembly 12 against the solid columm of liquid located in the well bore below the packer assembly 12. Accordingly, the packer assembly 12 can be successfully set in the well bore, even though a solid column of liquid does exist below the packer.

Having described but a single embodiment of the invention, it will be appreciated that many changes or modifications can be made thereto without departing from the spirit or scope of the invention.

What is claimed is:

1. A running and setting tool for a well packer, said packer having a tubular mandrel, upper and lower slip assemblies encircling the mandrel, a seal assembly located between the slip assemblies, and means on the mandrel including a setting sleeve for setting the slip assemblies, said tool comprising:

a tubular setting tool mandrel having a first end portion arranged for connection to a string of pipe for lowering the setting tool and packer into a well bore and having a second end portion;

releasable means on said setting tool mandrel releaseably connecting said setting tool mandrel to the packer mandrel, said releasable means includes a collet located on said setting tool mandrel, said collect having a plurality of collet portions arranged to engage the packer mandrel;

a tubular setting member encircling said setting tool mandrel in telescoping relationship, said tubular setting member having a first end releasably connected to the first end of said setting tool mandrel and having a second end arranged for engagement with the setting sleeve of the packer;

a variable volume chamber located between said setting tool mandrel and setting member;

a port in said setting tool mandrel connecting the interior of the setting tool mandrel with said chamber;

valve means in the second end portion of said setting tool mandrel for selectively preventing flow through the interior of said setting tool mandrel and causing flow into said chamber to move said setting member downwardly relative to said setting tool mandrel to set the slip assemblies; and, means on the second end portion of said setting tool mandrel for retaining said releasably means connected to the packet mandrel and for permitting said releasable means to disconnect from the packer mandrel upon upward movement of said setting tool mandrel upon upward movement of said setting tool mandrel relative to the packer whereby said running and setting tool can be withdrawn from the packer.

2. The tool of claim 1 wherein said means for releasing said tool from the packer includes:

an annular flange on said setting tool mandrel engaging said collet and retaining said collet in a radially outward position for engaging the pocket body; and, frangible means located on said setting tool mandrel relatively below said collet for preventing downward movement of said collet relative to said setting tool mandrel when intact and for permitting such downward movement when broken.

3. The tool of claim 2 wherein said frangible means includes a nut member threadably connected to said setting tool mandrel.

4. The tool of claim 3 and also including seal means sealingly and slidingly encircling said setting tool mandrel between said collet and frangible means and arranged to form a seal with the packer body.

5. The tool of claim 4 wherein said seal means includes:

an annular seal body;

a pair of spaced annular seals located in said seal body in sealing engagement with said setting tool mandrel; and, an elongated, annular seal assembly located on said seal body for sealingly engaging the packer body.

6. The tool of claim 5 wherein said setting tool mandrel includes an equalizing port extending radially therethrough for providing fluid communication between the interior of said setting tool mandrel and the well bore above the packer, said port being disposed between said spaced annular seals when said frangible means is intact and relatively above said uppermost of said spaced annular seals when said frangible means is broken.

7. The tool of claim 6 and including:

a second variable volume chamber located between said setting tool mandrel and setting member; and, a second port in said setting tool mandrel connecting the interior of said setting tool mandrel with said second variable volume chamber.

* * * * *